US010312629B2

(12) United States Patent
Burris et al.

(10) Patent No.: US 10,312,629 B2
(45) Date of Patent: Jun. 4, 2019

(54) COAXIAL CONNECTOR WITH INHIBITED INGRESS AND IMPROVED GROUNDING

(71) Applicant: Corning Optical Communication RF LLC, Glendale, AZ (US)

(72) Inventors: Donald Andrew Burris, Peoria, AZ (US); William Bernard Lutz, Glendale, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/882,456

(22) Filed: Jan. 29, 2018

(65) Prior Publication Data

US 2018/0166822 A1 Jun. 14, 2018

Related U.S. Application Data

(63) Continuation of application No. 14/884,385, filed on Oct. 15, 2015, now Pat. No. 9,905,959, which is a (Continued)

(51) Int. Cl.

| | |
|---|---|
| ***H01R 13/40*** | (2006.01) |
| ***H01R 13/52*** | (2006.01) |
| ***H01R 13/622*** | (2006.01) |
| ***H01R 24/40*** | (2011.01) |
| ***H01R 13/6584*** | (2011.01) |

(Continued)

(52) U.S. Cl.

CPC ..... *H01R 13/5202* (2013.01); *H01R 13/5205* (2013.01); *H01R 13/59* (2013.01); *H01R 13/622* (2013.01); *H01R 13/6584* (2013.01); *H01R 13/6593* (2013.01); *H01R 24/38* (2013.01); *H01R 24/40* (2013.01); *H01R 4/304* (2013.01); *H01R 13/631* (2013.01); *H01R 13/6471* (2013.01)

(58) Field of Classification Search

CPC ..... H01R 9/05; H01R 9/0524; H01R 9/0518; H01R 24/38; H01R 13/59; H01R 13/5202; H01R 13/6277

USPC ..... 439/578, 583–585, 322

See application file for complete search history.

(56) References Cited

U.S. PATENT DOCUMENTS

| | | |
|---|---|---|
| 331,169 A | 11/1885 | Thomas |
| 346,958 A | 8/1886 | Stone |

(Continued)

FOREIGN PATENT DOCUMENTS

| | | |
|---|---|---|
| CA | 2096710 | 11/1994 |
| CN | 1210379 | 3/1999 |

(Continued)

OTHER PUBLICATIONS

Office Action dated Sep. 14, 2018 pertaining to U.S. Appl. No. 15/698,784.

(Continued)

*Primary Examiner* — Hien D Vu

(74) *Attorney, Agent, or Firm* — Tamika A. Crawl-Bey

(57) ABSTRACT

A coaxial connector includes a body, a post, a coupling nut, and a sealing member. The sealing member is axially compressed between a rear end facing surface of the coupling nut and a front end facing surface of the hollow body in order to facilitate improved grounding and RF shielding characteristics.

9 Claims, 15 Drawing Sheets

Related U.S. Application Data continuation of application No. 13/084,099, filed on Apr. 11, 2011, now Pat. No. 9,166,348.

(60) Provisional application No. 61/323,597, filed on Apr. 13, 2010.

(51) Int. Cl.

| | |
|---|---|
| ***H01R 13/6593*** | (2011.01) |
| ***H01R 13/59*** | (2006.01) |
| ***H01R 24/38*** | (2011.01) |
| *H01R 4/30* | (2006.01) |
| *H01R 13/631* | (2006.01) |
| *H01R 13/6471* | (2011.01) |

(56) References Cited

U.S. PATENT DOCUMENTS

| | | | |
|---|---|---|---|
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |
| 2,102,495 | A | 12/1937 | England |
| 2,258,528 | A | 10/1941 | Wurzburger |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,743,505 | A | 5/1956 | Hill |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,161,451 | A | 12/1964 | Neidecker |
| 3,184,706 | A | 5/1965 | Atkins |
| 3,193,309 | A | 7/1965 | Morris |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Schwartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaloene |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,824,026 | A | 7/1974 | Gaskins |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,847,463 | A | 11/1974 | Hayward et al. |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |

(56) References Cited

U.S. PATENT DOCUMENTS 3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,169,646 A 10/1979 Stape et al.
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,453,200 A 6/1984 Trcka et al.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.

(56) References Cited

U.S. PATENT DOCUMENTS 4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,274 A 7/1988 Bowers
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,185,655 A 2/1993 Glenday et al.
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,263,880 A 11/1993 Schwarz et al.
5,269,701 A 12/1993 Leibfried, Jr.
5,281,762 A 1/1994 Long et al.
5,283,417 A 2/1994 Misawa et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth

(56) References Cited

U.S. PATENT DOCUMENTS

| | | | |
|---|---|---|---|
| 5,435,751 | A | 7/1995 | Papenheim et al. |
| 5,435,760 | A | 7/1995 | Miklos |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,475,921 | A | 12/1995 | Johnston |
| 5,488,268 | A | 1/1996 | Bauer et al. |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,511,305 | A | 4/1996 | Garner |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,566,173 | A | 10/1996 | Steinbrecher |
| 5,571,028 | A | 11/1996 | Szegda |
| 5,571,029 | A | 11/1996 | Poissant et al. |
| 5,586,910 | A | 12/1996 | Del Negro et al. |
| 5,595,499 | A | 1/1997 | Zander et al. |
| 5,598,132 | A | 1/1997 | Stabile |
| 5,607,320 | A | 3/1997 | Wright |
| 5,607,325 | A | 3/1997 | Toma |
| 5,609,501 | A | 3/1997 | McMills et al. |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,649,723 | A | 7/1997 | Larsson |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,743,131 | A | 4/1998 | Holliday et al. |
| 5,746,617 | A | 5/1998 | Porter, Jr. et al. |
| 5,746,619 | A | 5/1998 | Harting et al. |
| 5,759,618 | A | 6/1998 | Taylor |
| 5,761,053 | A | 6/1998 | King et al. |
| 5,769,652 | A | 6/1998 | Wider |
| 5,769,662 | A | 6/1998 | Stabile et al. |
| 5,774,344 | A | 6/1998 | Casebolt |
| 5,775,927 | A | 7/1998 | Wider |
| 5,788,289 | A | 8/1998 | Cronley |
| 5,791,698 | A | 8/1998 | Wartluft et al. |
| 5,797,633 | A | 8/1998 | Katzer et al. |
| 5,817,978 | A | 10/1998 | Hermant et al. |
| 5,863,220 | A | 1/1999 | Holliday |
| 5,874,603 | A | 2/1999 | Arkles |
| 5,877,452 | A | 3/1999 | McConnell |
| 5,879,191 | A | 3/1999 | Burris |
| 5,882,226 | A | 3/1999 | Bell et al. |
| 5,890,924 | A | 4/1999 | Endo |
| 5,897,795 | A | 4/1999 | Lu et al. |
| 5,906,511 | A | 5/1999 | Bozzer et al. |
| 5,917,153 | A | 6/1999 | Geroldinger |
| 5,921,793 | A | 7/1999 | Phillips |
| 5,929,383 | A | 7/1999 | Marik et al. |
| 5,938,465 | A | 8/1999 | Fox, Sr. |
| 5,944,548 | A | 8/1999 | Saito |
| 5,951,327 | A | 9/1999 | Marik |
| 5,954,708 | A | 9/1999 | Lopez et al. |
| 5,957,716 | A | 9/1999 | Buckley et al. |
| 5,967,852 | A | 10/1999 | Follingstad et al. |
| 5,975,479 | A | 11/1999 | Suter |
| 5,975,591 | A | 11/1999 | Guest |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,042,429 | A | 3/2000 | Bianca et al. |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Barthlomew |
| 6,080,015 | A | 6/2000 | Andreescu |
| 6,083,030 | A | 7/2000 | Wright |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,126,487 | A | 10/2000 | Rosenberger et al. |
| 6,132,234 | A | 10/2000 | Waidner et al. |
| 6,142,812 | A | 11/2000 | Hwang |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,158,298 | A | 12/2000 | Hara |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,942 | B1 | 6/2001 | Lemke et al. |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Areykiewicz et al. |
| 6,271,464 | B1 | 8/2001 | Cunningham |
| 6,299,475 | B1 | 10/2001 | Huspeni et al. |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,379,183 | B1 | 4/2002 | Ayres et al. |
| 6,394,840 | B1 | 5/2002 | Gassauer et al. |
| 6,396,367 | B1 | 5/2002 | Rosenberger |
| D458,904 | S | 6/2002 | Montena |
| 6,398,571 | B1 | 6/2002 | Nishide et al. |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |

(56) References Cited

U.S. PATENT DOCUMENTS

| | | | |
|---|---|---|---|
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,443,763 | B1 | 9/2002 | Richet |
| 6,450,829 | B1 | 9/2002 | Weisz-Margulescu |
| 6,454,463 | B1 | 9/2002 | Halbach |
| 6,464,526 | B1 | 10/2002 | Seufert et al. |
| 6,464,527 | B2 | 10/2002 | Volpe et al. |
| 6,467,816 | B1 | 10/2002 | Huang |
| 6,468,100 | B1 | 10/2002 | Meyer et al. |
| 6,468,103 | B1 | 10/2002 | Brower |
| 6,491,546 | B1 | 12/2002 | Perry |
| D468,696 | S | 1/2003 | Montena |
| 6,506,083 | B1 | 1/2003 | Bickford et al. |
| 6,510,610 | B2 | 1/2003 | Losinger |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,632,104 | B2 | 10/2003 | Quadir |
| 6,634,906 | B1 | 10/2003 | Yeh |
| 6,637,101 | B2 | 10/2003 | Hathaway et al. |
| 6,645,011 | B2 | 11/2003 | Schneider et al. |
| 6,663,397 | B1 | 12/2003 | Lin et al. |
| 6,676,446 | B2 | 1/2004 | Montena |
| 6,683,253 | B1 | 1/2004 | Lee |
| 6,683,773 | B2 | 1/2004 | Montena |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,709,289 | B2 | 3/2004 | Huber et al. |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,690,081 | B2 | 9/2004 | Burris et al. |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhezaleh |
| 6,802,738 | B1 | 10/2004 | Henningsen |
| 6,805,581 | B2 | 10/2004 | Chen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,944,005 | B2 | 9/2005 | Kooiman |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 6,979,234 | B2 | 12/2005 | Bleicher |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,062,851 | B2 | 6/2006 | Koessler |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,168,992 | B2 | 1/2007 | Vo et al. |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,238,047 | B2 | 7/2007 | Saetele et al. |
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |
| 7,278,882 | B1 | 10/2007 | Li |
| 7,288,002 | B2 | 10/2007 | Rodrigues et al. |
| 7,229,550 | B2 | 11/2007 | Montena |

(56) References Cited

U.S. PATENT DOCUMENTS 7,291,033 B2 11/2007 Hu
7,297,023 B2 11/2007 Chawgo
7,299,550 B2 11/2007 Montena
7,303,435 B2 12/2007 Burris et al.
7,311,555 B1 12/2007 Burris et al.
7,318,609 B2 1/2008 Naito et al.
7,322,846 B2 1/2008 Camelio
7,322,851 B2 1/2008 Brookmire
7,329,139 B2 2/2008 Benham
7,331,820 B2 2/2008 Burris et al.
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,371,113 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 1/2009 Bence et al.
7,484,988 B2 2/2009 Ma et al.
7,484,997 B2 2/2009 Hofling
7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,513,795 B1 4/2009 Shaw
7,537,482 B2 5/2009 Burris et al.
7,540,759 B2 6/2009 Liu et al.
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,588,460 B2 9/2009 Malloy et al.
7,607,942 B1 10/2009 Van Swearingen
7,625,227 B1 12/2009 Henderson et al.
7,632,143 B1 12/2009 Islam
7,635,283 B1 12/2009 Islam
7,648,383 B2 1/2010 Burris et al.
7,651,376 B2 1/2010 Schreier
7,674,132 B1 3/2010 Chen
7,682,177 B2 3/2010 Berthet
7,682,188 B1 3/2010 Lu
7,694,420 B2 4/2010 Ehret et al.
7,714,229 B2 5/2010 Burris et al.
7,726,996 B2 6/2010 Burris et al.
7,727,011 B2 6/2010 Montena et al.
7,749,021 B2 7/2010 Brodeur
7,749,022 B2 7/2010 Amidon et al.
7,753,705 B2 7/2010 Montena
7,753,710 B2 7/2010 George
7,753,727 B1 7/2010 Islam et al.
7,758,356 B2 7/2010 Burris et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
7,814,654 B2 10/2010 Pichler
D626,920 S 11/2010 Purdy et al.
7,824,216 B2 11/2010 Purdy
7,828,594 B2 11/2010 Burris et al.
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,914,326 B2 3/2011 Sutter
7,918,687 B2 4/2011 Paynter et al.
7,927,135 B1 4/2011 Wlos
7,934,954 B1 5/2011 Chawgo et al.
7,934,955 B1 5/2011 Hsia
7,938,662 B2 5/2011 Burris et al.
7,942,695 B1 5/2011 Lu
7,950,958 B2 5/2011 Mathews
7,950,961 B2 5/2011 Chabalowski et al.
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,037,599 B2 10/2011 Pichler
8,047,872 B2 11/2011 Burris et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,172,612 C1 5/2012 Bence et al.
8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,310 B2 10/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,319,136 B2 11/2012 Byron et al.
8,323,053 B2 12/2012 Montena
8,323,058 B2 12/2012 Flaherty et al.
8,323,060 B2 * 12/2012 Purdy ..... H01R 9/0524
439/792
8,337,229 B2 12/2012 Montena
8,366,481 B2 2/2013 Ehret et al.
8,366,482 B2 2/2013 Burris et al.

(56) References Cited

U.S. PATENT DOCUMENTS

| | | | |
|---|---|---|---|
| 8,376,769 | B2 | 2/2013 | Holland et al. |
| D678,844 | S | 3/2013 | Haberek |
| 8,398,421 | B2 | 3/2013 | Haberek et al. |
| 8,430,688 | B2 | 4/2013 | Montena et al. |
| 8,449,326 | B2 | 5/2013 | Holland et al. |
| 8,465,322 | B2 | 6/2013 | Purdy |
| 8,469,739 | B2 | 6/2013 | Rodrigues et al. |
| 8,469,740 | B2 | 6/2013 | Ehret et al. |
| D686,164 | S | 7/2013 | Haberek et al. |
| D686,576 | S | 7/2013 | Haberek et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,517,764 | B2 | 8/2013 | Wei et al. |
| 8,529,279 | B2 | 9/2013 | Montena |
| 8,550,835 | B2 | 10/2013 | Montena |
| 8,556,656 | B2 | 10/2013 | Thomas et al. |
| 8,568,163 | B2 | 10/2013 | Burris et al. |
| 8,568,165 | B2 | 10/2013 | Wei et al. |
| 8,591,244 | B2 | 11/2013 | Thomas et al. |
| 8,597,050 | B2 | 12/2013 | Flaherty et al. |
| 8,622,776 | B2 | 1/2014 | Morikawa |
| 8,636,529 | B2 | 1/2014 | Stein |
| 8,636,541 | B2 | 1/2014 | Chastain et al. |
| 8,647,136 | B2 | 2/2014 | Purdy et al. |
| 7,114,990 | C1 | 4/2014 | Bence et al. |
| 8,690,603 | B2 | 4/2014 | Bence et al. |
| 8,721,365 | B2 | 5/2014 | Holland |
| 8,727,800 | B2 | 5/2014 | Holland et al. |
| 8,758,050 | B2 | 6/2014 | Montena |
| 8,777,658 | B2 | 7/2014 | Holland et al. |
| 8,777,661 | B2 | 7/2014 | Holland et al. |
| 8,834,200 | B2 | 9/2014 | Shaw |
| 8,858,251 | B2 | 10/2014 | Montena |
| 8,888,526 | B2 | 11/2014 | Burris |
| 8,920,192 | B2 | 12/2014 | Montena |
| 6,558,194 | C1 | 1/2015 | Montena |
| 6,848,940 | C1 | 1/2015 | Montena |
| 9,017,101 | B2 | 4/2015 | Ehret et al. |
| 9,048,599 | B2 | 6/2015 | Burris |
| 9,153,911 | B2 | 10/2015 | Burris et al. |
| 9,166,307 | B2 | 10/2015 | Shaw |
| 9,166,348 | B2 | 10/2015 | Burris et al. |
| 9,172,154 | B2 | 10/2015 | Burris |
| 9,172,157 | B2 | 10/2015 | Burris |
| 9,306,324 | B2 | 4/2016 | Wei |
| 9,343,855 | B2 | 5/2016 | Wei |
| 2001/0034143 | A1 | 10/2001 | Annequin |
| 2001/0046802 | A1 | 11/2001 | Perry et al. |
| 2001/0051448 | A1 | 12/2001 | Gonzalez |
| 2002/0013088 | A1 | 1/2002 | Rodrigues et al. |
| 2002/0019161 | A1 | 2/2002 | Finke et al. |
| 2002/0038720 | A1 | 4/2002 | Kai et al. |
| 2002/0064014 | A1 | 5/2002 | Montena |
| 2002/0146935 | A1 | 10/2002 | Wong |
| 2003/0110977 | A1 | 6/2003 | Batlaw |
| 2003/0119358 | A1 | 6/2003 | Henningsen |
| 2003/0139081 | A1 | 7/2003 | Hall et al. |
| 2003/0194890 | A1 | 10/2003 | Ferderer et al. |
| 2003/0214370 | A1 | 11/2003 | Allison et al. |
| 2003/0224657 | A1 | 12/2003 | Malloy |
| 2004/0031144 | A1 | 2/2004 | Holland |
| 2004/0077215 | A1 | 4/2004 | Palinkas et al. |
| 2004/0102089 | A1 | 5/2004 | Chee |
| 2004/0137778 | A1 | 7/2004 | Mattheeuws et al. |
| 2004/0157499 | A1 | 8/2004 | Nania et al. |
| 2004/0194585 | A1 | 10/2004 | Clark |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0079762 | A1 | 4/2005 | Hsia |
| 2005/0159045 | A1 | 7/2005 | Huang |
| 2005/0164553 | A1 | 7/2005 | Montena |
| 2005/0170692 | A1 | 8/2005 | Montena |
| 2005/0181652 | A1 | 8/2005 | Montena et al. |
| 2005/0181668 | A1 | 8/2005 | Montena et al. |
| 2005/0208827 | A1 | 9/2005 | Burris et al. |
| 2005/0233636 | A1 | 10/2005 | Rodrigues et al. |
| 2006/0014425 | A1 | 1/2006 | Montena |
| 2006/0099853 | A1 | 5/2006 | Sattele et al. |
| 2006/0110977 | A1 | 5/2006 | Matthews |
| 2006/0113107 | A1 | 6/2006 | Williams |
| 2006/0154519 | A1 | 7/2006 | Montena |
| 2006/0166552 | A1 | 7/2006 | Bence et al. |
| 2006/0178034 | A1 | 8/2006 | Shimirak |
| 2006/0178046 | A1 | 8/2006 | Tusini |
| 2006/0194465 | A1 | 8/2006 | Czikora |
| 2006/0199040 | A1 | 9/2006 | Yamada |
| 2006/0223355 | A1 | 10/2006 | Hirschmann |
| 2006/0246774 | A1 | 11/2006 | Buck |
| 2006/0258209 | A1 | 11/2006 | Hall |
| 2006/0276079 | A1 | 12/2006 | Chen |
| 2007/0004276 | A1 | 1/2007 | Stein |
| 2007/0026734 | A1 | 2/2007 | Bence et al. |
| 2007/0049113 | A1 | 3/2007 | Rodrigues et al. |
| 2007/0054535 | A1 | 3/2007 | Hall et al. |
| 2007/0059968 | A1 | 3/2007 | Ohtaka et al. |
| 2007/0082533 | A1 | 4/2007 | Currier et al. |
| 2007/0087613 | A1 | 4/2007 | Schumacher et al. |
| 2007/0093128 | A1 | 4/2007 | Thomas et al. |
| 2007/0123101 | A1 | 5/2007 | Palinkas |
| 2007/0155232 | A1 | 7/2007 | Burris et al. |
| 2007/0155233 | A1 | 7/2007 | Laerke et al. |
| 2007/0173100 | A1 | 7/2007 | Benham |
| 2007/0175027 | A1 | 8/2007 | Khemakhem et al. |
| 2007/0232117 | A1 | 10/2007 | Singer |
| 2007/0243759 | A1 | 10/2007 | Rodrigues et al. |
| 2007/0243762 | A1 | 10/2007 | Burke et al. |
| 2007/0287328 | A1 | 12/2007 | Hart et al. |
| 2008/0032556 | A1 | 2/2008 | Schreier |
| 2008/0102696 | A1 | 5/2008 | Montena |
| 2008/0171466 | A1 | 7/2008 | Buck et al. |
| 2008/0200066 | A1 | 8/2008 | Hofling |
| 2008/0200068 | A1 | 8/2008 | Aguirre |
| 2008/0214040 | A1 | 9/2008 | Holterhoff et al. |
| 2008/0274644 | A1 | 11/2008 | Rodrigues |
| 2008/0289470 | A1 | 11/2008 | Aston |
| 2008/0310026 | A1 | 12/2008 | Nakayama |
| 2009/0029590 | A1 | 1/2009 | Sykes et al. |
| 2009/0098770 | A1 | 4/2009 | Bence et al. |
| 2009/0104801 | A1 | 4/2009 | Silva |
| 2009/0163075 | A1 | 6/2009 | Blew et al. |
| 2009/0186505 | A1 | 7/2009 | Mathews |
| 2009/0264003 | A1 | 10/2009 | Hertzler et al. |
| 2009/0305560 | A1 | 12/2009 | Chen |
| 2010/0007441 | A1 | 1/2010 | Yagisawa et al. |
| 2010/0022125 | A1 | 1/2010 | Burris et al. |
| 2010/0028563 | A1 | 2/2010 | Ota |
| 2010/0055978 | A1 | 3/2010 | Montena |
| 2010/0080563 | A1 | 4/2010 | DiFonzo et al. |
| 2010/0081321 | A1 | 4/2010 | Malloy et al. |
| 2010/0081322 | A1 | 4/2010 | Malloy et al. |
| 2010/0087071 | A1 | 4/2010 | DiFonzo et al. |
| 2010/0105246 | A1 | 4/2010 | Burris et al. |
| 2010/0124839 | A1 | 5/2010 | Montena |
| 2010/0130060 | A1 | 5/2010 | Islam |
| 2010/0178799 | A1 | 7/2010 | Lee |
| 2010/0216339 | A1 | 8/2010 | Burris et al. |
| 2010/0233901 | A1 | 9/2010 | Wild et al. |
| 2010/0233902 | A1 | 9/2010 | Youtsey |
| 2010/0233903 | A1 | 9/2010 | Islam |
| 2010/0255719 | A1 | 10/2010 | Purdy |
| 2010/0255720 | A1 | 10/2010 | Radzik et al. |
| 2010/0255721 | A1 | 10/2010 | Purdy et al. |
| 2010/0273351 | A1 | 10/2010 | Holliday |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2010/0304579 | A1 | 12/2010 | Kisling |
| 2010/0323541 | A1 | 12/2010 | Amidon et al. |

(56) References Cited

U.S. PATENT DOCUMENTS

| | | | |
|---|---|---|---|
| 2011/0021072 | A1 | 1/2011 | Purdy |
| 2011/0021075 | A1 | 1/2011 | Orner et al. |
| 2011/0027039 | A1 | 2/2011 | Blair |
| 2011/0039448 | A1 | 2/2011 | Stein |
| 2011/0053413 | A1 | 3/2011 | Mathews |
| 2011/0074388 | A1 | 3/2011 | Bowman |
| 2011/0080158 | A1 | 4/2011 | Lawrence et al. |
| 2011/0111623 | A1 | 5/2011 | Burris et al. |
| 2011/0111626 | A1 | 5/2011 | Paglia et al. |
| 2011/0117774 | A1 | 5/2011 | Malloy et al. |
| 2011/0143567 | A1 | 6/2011 | Purdy et al. |
| 2011/0151714 | A1 | 6/2011 | Flaherty et al. |
| 2011/0230089 | A1 | 9/2011 | Amidon et al. |
| 2011/0230091 | A1 | 9/2011 | Krenceski et al. |
| 2011/0237123 | A1 | 9/2011 | Burris et al. |
| 2011/0237124 | A1 | 9/2011 | Flaherty et al. |
| 2011/0250789 | A1 | 10/2011 | Burris et al. |
| 2011/0318958 | A1 | 12/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0064768 | A1 | 3/2012 | Islam et al. |
| 2012/0094530 | A1 | 4/2012 | Montena |
| 2012/0100751 | A1 | 4/2012 | Montena |
| 2012/0108098 | A1 | 5/2012 | Burris et al. |
| 2012/0122329 | A1 | 5/2012 | Montena |
| 2012/0129387 | A1 | 5/2012 | Holland et al. |
| 2012/0159740 | A1 | 6/2012 | Strelow et al. |
| 2012/0171894 | A1 | 7/2012 | Malloy et al. |
| 2012/0178289 | A1 | 7/2012 | Holliday |
| 2012/0202378 | A1 | 8/2012 | Krenceski et al. |
| 2012/0222302 | A1 | 9/2012 | Purdy et al. |
| 2012/0225581 | A1 | 9/2012 | Amidon et al. |
| 2012/0315788 | A1 | 12/2012 | Montena |
| 2012/0329311 | A1 | 12/2012 | Duval et al. |
| 2013/0059468 | A1 | 3/2013 | Wood |
| 2013/0065433 | A1 | 3/2013 | Burris |
| 2013/0072057 | A1 | 3/2013 | Burris |
| 2013/0178096 | A1 | 7/2013 | Matzen |
| 2013/0273761 | A1 | 10/2013 | Ehret et al. |
| 2014/0106612 | A1 | 4/2014 | Burris |
| 2014/0106614 | A1 | 4/2014 | Burris et al. |
| 2014/0120766 | A1 | 5/2014 | Meister et al. |
| 2014/0137393 | A1 | 5/2014 | Chastain et al. |
| 2014/0148044 | A1 | 5/2014 | Balcer et al. |
| 2014/0148051 | A1 | 5/2014 | Bence et al. |
| 2014/0154907 | A1 | 6/2014 | Ehret et al. |
| 2014/0106613 | A1 | 7/2014 | Burris |
| 2014/0298650 | A1 | 10/2014 | Chastain et al. |
| 2014/0322968 | A1 | 10/2014 | Burris |
| 2014/0342605 | A1 | 11/2014 | Burris et al. |
| 2015/0118901 | A1 | 4/2015 | Burris |
| 2015/0295331 | A1 | 10/2015 | Burris |
| 2016/0118727 | A1 | 4/2016 | Burris et al. |
| 2016/0118748 | A1 | 4/2016 | Burris et al. |
| 2017/0025801 | A1 | 1/2017 | Edmonds |

FOREIGN PATENT DOCUMENTS

| | | |
|---|---|---|
| CN | 1292940 | 4/2001 |
| CN | 201149936 | 11/2008 |
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3117320 | 4/1982 |
| DE | 3211008 | 10/1983 |
| DE | 9001608.4 | 4/1990 |
| DE | 4439852 | 5/1996 |
| DE | 19749130 | 8/1999 |
| DE | 19957518 | 9/2001 |
| DE | 10346914 | 5/2004 |
| DE | 102004031271 | 1/2006 |
| DE | 102010064071 | 12/2010 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1010372 | 11/1963 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 2000-40564 | 2/2000 |
| JP | 2002-015823 | 1/2002 |
| JP | 200215823 | 1/2002 |
| JP | 4129978 | 8/2008 |
| JP | 4219778 | 2/2009 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| TW | 200810279 | 2/2008 |
| TW | 200843262 | 11/2008 |
| TW | 201140953 | 11/2011 |
| WO | 8700351 | 1/1987 |
| WO | 9908343 | 2/1999 |
| WO | 00/05785 | 2/2000 |
| WO | 186756 | 11/2001 |
| WO | 2069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Office Action dated May 11, 2018 pertaining to U.S. Appl. No. 15/874,306.

Office Action dated Feb. 15, 2018 pertaining to U.S. Appl. No. 14/259,703.

Corning Gilbert 2004 OEM Coaxial Products Catalog, Quick Disconnects, 2 pages.

(56) References Cited

OTHER PUBLICATIONS

Digicon AVL Connector. Arris Group Inc. [online] 3 pages. Retrieved from the Internet: <URL: http://www.arrisi.com/special/digiconAVL.asp.
U.S. Office Action, U.S. Appl. No. 10/997,218; dated Jul. 31, 2006, pp. 1-10.
Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
U.S. Reexamination Control No. 90/012,300 filed Jun. 29, 2012, regarding U.S. Pat. No. 8,172,612 filed May 27, 2011 (Bence et al.).
U.S. Reexamination Control No. 90/012,749 filed Dec. 21, 2012, regarding U.S. Pat. No. 7,114,990, filed Jan. 25, 2005 (Bence et al.).
U.S. Reexamination Control No. 90/012,835 filed Apr. 11, 2013, regarding U.S. Pat. No. 8,172,612 filed May 27, 2011 (Bence et al.).
Notice of Allowance (dated Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
PPC, "Next Generation Compression Connectors," pp. 1-6, Retrieved from http://www.tessco.com/yts/partnermanufacturer list/vendors/ppc/pdf/ppc digital spread.pdf.
Patent Cooperation Treaty, International Search Report for PCT/US2013/070497, dated Feb. 11, 2014, 3 pgs.
Patent Cooperation Treaty, International Search Report for PCT/US2013/064515, 10 pgs.
Patent Cooperation Treaty, International Search Report for PCT/US2013/064512, dated Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Reexamination Control No. 90/013,068 filed Nov. 27, 2013, regarding U.S. Pat. No. 6,558,194 filed Jul. 21, 2000 (Montena).
U.S. Reexamination Control No. 90/013,069 filed Nov. 27, 2013, regarding U.S. Pat. No. 6,848,940 filed Jan. 21, 2003 (Montena).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, dated Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, dated Apr. 30, 2015, 9 pages.
Patent Cooperation Treaty, International Preliminary Report on Patentability for PCT/US2013/064515, dated Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.

(56) References Cited

OTHER PUBLICATIONS

Report on the Filing or Determination of an Action Regarding a Patent or Trademark regarding U.S. Pat. No. 8,313,353; 8,313,345; 8,323,060—Eastern District of Arkansas.
Report on the Filing or Determination of an Action Regarding a Patent or Trademark regarding U.S. Pat. No. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.
European Search Report dated Apr. 8, 2015 pertaining to European Patent Application No. 13733586.5.
Search Report dated Mar. 19, 2013 pertaining to International application No. PCT/US2013/20001.
Office Action dated Feb. 29, 2016 pertaining to U.S. Appl. No. 14/795,367.
Office Action dated May 3, 2016 pertaining to U.S. Appl. No. 14/750,435.
Office Action dated May 20, 2016 pertaining to U.S. Appl. No. 13/927,537.
Chinese Search Report dated Jan. 19, 2016 pertaining to Chinese Application No. 2013800048358.
Taiwan Search Report dated Mar. 28, 2016 pertaining to Taiwanese Application No. 102100147.
Office Action dated Aug. 26, 2016 pertaining to U.S. Appl. No. 15/019,498.
Office Action dated Sep. 1, 2016 pertaining to U.S. Appl. No. 14/259,703.
Office Action dated Sep. 23, 2016 pertaining to U.S. Appl. No. 14/872,842.
Notice of Allowance dated Sep. 23, 2016 pertaining to U.S. Appl. No. 13/927,537.
Notice of Allowance dated Sep. 19, 2016 pertaining to U.S. Appl. No. 14/928,552.
Office Action dated Jul. 5, 2016 pertaining to U.S. Appl. No. 14/795,367.
Office Action dated Nov. 7, 2016 pertaining to U.S. Appl. No. 15/278,825.
Corning Cablecon CX3 Compression Catalogue; Rev. May 2012; 16 pages.
International Search Report and Written Opinion of the International Searching Authority; PCT/US2016/017294; dated May 11, 2016.
TW102137009 Search Report dated Sep. 26, 2016; 1 page, Taiwan Patent Office.
Office Action dated Jan. 20, 2017 pertaining to U.S. Appl. No. 14/797,575.
Office Action dated Nov. 29, 2016 pertaining to U.S. Appl. No. 14/844,592.
Apple Rubber Products Seal Design Guide 75; Mary K. Chaffee et al eds.; 2009; available at http://www.applerubber.com/src/pdf/seal-design-guide.pdf.
Whitlock, J. et al.; The Seal Man's O'Ring Handbook; Eric Jackson ed.; EPM, Inc.; 1st ed. 2004; pp. 1-36; available at https://www.physics.harvard.edu/uploads/files/machineshop/epm_oring_handbook.pdf.
O-Ring Identification Chart; Universal Air Conditioner, Inc.; available at https://www.uacparts.com/Downloads/UAC%20Oring%20Chart.pdf.
Office Action dated May 5, 2017 pertaining to U.S. Appl. No. 15/255,625.
Office Action dated Jul. 25, 2017 pertaining to U.S. Appl. No. 14/259,703.
Ex Parte Quayle dated May 18, 2017 pertaining to U.S. Appl. No. 15/342,709.
Office Action dated May 9, 2017 pertaining to U.S. Appl. No. 14/884,385.
Office Action dated Aug. 29, 2017 pertaining to U.S. Appl. No. 15/342,598.
Office Action dated Sep. 21, 2017 pertaining to U.S. Appl. No. 14/797,575.
Office Action dated Sep. 6, 2017 pertaining to U.S. Appl. No. 14/844,592.

* cited by examiner

COAXIAL CONNECTOR WITH INHIBITED INGRESS AND IMPROVED GROUNDING

CROSS-REFERENCE TO RELATED APPLICATIONS

This application is a continuation of U.S. application Ser. No. 14/884,385, filed Oct. 15, 2015, which is a continuation of U.S. application Ser. No. 13/084,099, which granted as U.S. Pat. No. 9,166,348 B1, was filed Apr. 11, 2011, and which claims the benefit of, and priority to, U.S. Provisional Patent Application Ser. No. 61/323,597, filed on Apr. 13, 2010. The contents of these applications are incorporated herein by reference in their entirety. This application is related to U.S. application Ser. No. 14/329,093, filed Jul. 11, 2014, which is a division of U.S. application Ser. No. 13/084,099, filed Apr. 11, 2011, and is now abandoned.

BACKGROUND

Field

The disclosure relates generally to coaxial cable connectors, and particularly to coaxial cable connectors capable of connecting a coaxial cable to a terminal.

Technical Background

With the advent of digital signal in CATV systems, a rise in customer complaints due to poor picture quality in the form of signal interference resulting in what is known as "tiling" and the like has occurred. Complaints of this nature result in CATV system operators having to send a technician to address the issue. Frequently, it is reported by the technician that the cause of the problem is a loose F connector fitting. Type F connector fittings may be loose for many reasons, sometimes they are not properly tightened due to installation rules of system operators that prohibit the use of wrenches in-doors on customer equipment. Other times, a homeowner may relocate equipment after the technician departs and may not adequately secure the F connectors. Additionally, some claim that F connector couplers loosen due to vibration and/or heat and cold cycles.

In any event, an improperly installed connector may result in poor signal transfer because there are discontinuities along the electrical path between the devices, resulting in a leak of radio frequency ("RF") signal. That leak may be in the form of signal egress where the RF energy radiates out of the connector/cable arrangement. Alternately, an RF leak may be in the form of signal ingress where RF energy from an external source or sources may enter the connector/cable arrangement causing a signal to noise ratio problem resulting in an unacceptable picture.

F connectors typically rely on intimate contact between the F male connector interface and the F female connector interface. If for some reason, the connector interfaces are allowed to pull apart from each other, such as in the case of a loose F male coupler, an interface "gap" may result. This gap can be a point of an RF leak as previously described. Typically, in such situations where the F male coupler is loose, the configuration allows for two distinct signal ingress paths. One path is found from the "back" of the F male coupler between the coupler bore and connector body. When the coupler is loosened, the connector body is permitted to move about, creating gaps that were previously secured when the connection was tight. Typically, these gaps allow a signal path along a relatively straightforward line. The other path is found at the "front" of the F male coupler along the spiral path of the interconnecting thread system. In the loose condition, tolerances in the thread system allow signal ingress because the flanks of the treads are not intimately engaged enough to provide adequate shielding.

To at least partially address the signal ingress and grounding issues, a number of approaches have been introduced, including U.S. Pat. No. 7,114,990 (Bence, et al.); U.S. Pat. No. 7,479,035 (Bence, et al.); U.S. Pat. No. 6,716,062 (Palinkas, et al.) and US Patent application 2008/0102696 (Montena). In addition, other approaches have been introduced to at least partially address the issue of loosening Type F couplers, including a lock-washer design produced by Phoenix Communications Technologies International (PCT) known at the DRS and TRS connectors. However, there is a continuing need for improved connector designs that address theses issues simultaneously.

SUMMARY

One embodiment of the disclosure relates to a coaxial connector for coupling an end of a coaxial cable to a terminal. The coaxial connector includes a hollow body having a front end, a rear end, and an internal surface extending between the front end and the rear end, the internal surface defining a longitudinal opening. The coaxial connector also includes a tubular post disposed at least partially within the longitudinal opening of the hollow body. The tubular post includes a front end, a rear end, a tubular shank adjacent to the rear end, and a flange adjacent to the front end, wherein the flange has an outer diameter that is larger than the outer diameter of the tubular shank. In addition, the coaxial connector includes a coupling nut having a front end, and a rear end, and a radially inward directed collar with a circular aperture formed therein. The circular aperture has a diameter that is less than the outer diameter of the flange of the tubular post and a front end facing surface of the radially inward directed collar rotationally engages a rear end facing surface of the flange of the tubular post. The coaxial connector further includes a sealing member disposed between a rear end facing surface of the radially inward directed collar and a front end facing surface of the hollow body. The sealing member is axially compressed by the rear end facing surface of the radially inward directed collar and the front end facing surface of the hollow body.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION OF THE PREFERRED EMBODIMENTS

Figure 1:
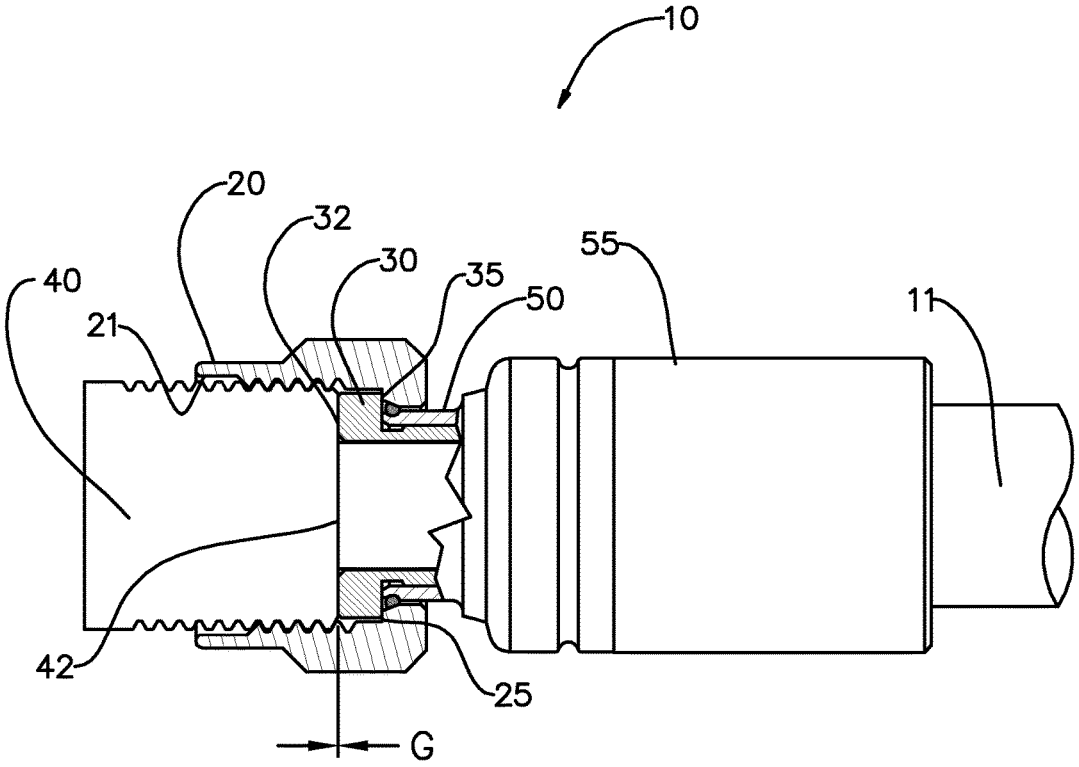
FIG. 1 PRIOR ART
FIG. 1 illustrates a partial cross sectional view of a prior art connector in a state of proper engagement with a terminal or port.

Reference will now be made in detail to embodiments of coaxial connectors, examples of which are illustrated in the accompanying drawings. Whenever possible, the same reference numerals will be used throughout the drawings to refer to the same or like parts.

Referring to FIG. 1, a prior art coaxial connector 10 has a coupling nut 20, a post 30, a body 50, and a compression ring 55. The coaxial connector 10 is an axial-compression type coaxial connector and the connection of the coaxial connector 10 to a coaxial 11 cable is known in the art. The coaxial connector 10 is illustrated in FIG. 1 in its attached, compressed state. When properly tightened to port 40, the gap "G" between post face 32 and port face 42 is completely closed. In other words, post face 32 and port face 42 are in intimate contact.

Figure 2:
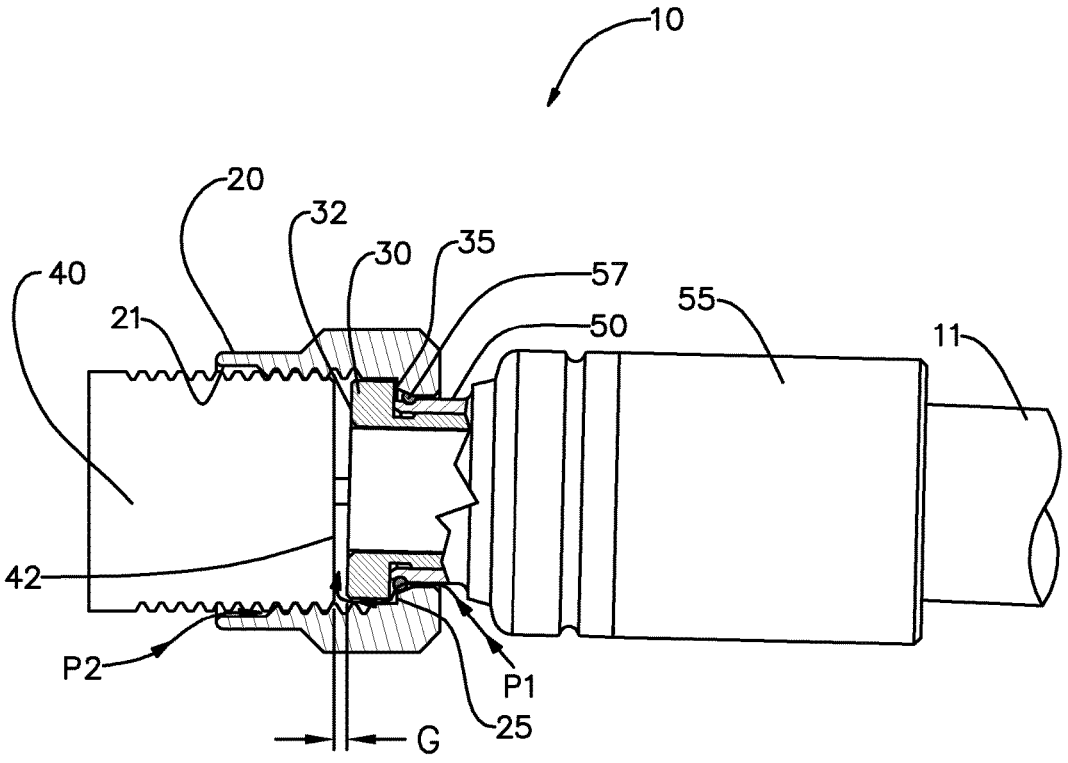
FIG. 2 PRIOR ART
FIG. 2 illustrates a partial cross sectional view of the connector illustrated in FIG. 1 in a state of improper engagement (otherwise known as "loose") with a terminal or port.

FIG. 2 illustrates coaxial connector 10 and port 40 of FIG. 1, wherein coupling nut 20 of connector 10 is not fully tightened thereby allowing post face 32 and port face 42 to be spaced apart at gap "G". The resultant gap "G" and clearances between internal features of coupler 20 and body 50 result in a relatively unobstructed ingress path "P1". RF (Radio Frequency) signal ingress travels along this path into the connector interface allowing undesirable electrical interference. The RF ingress path is unimpeded by non-conductive materials such as o-ring 57. A secondary ingress path "P2" is created when the internal threaded portion of coupler 20 is not loaded against external threaded portion of port 40. Said secondary ingress path "P2" is abetted by relatively large mechanical clearances between pilot bore 21 of coupler 20 and external surfaces of port 42. Body 50 and post 30 of connector 10 are permitted to angle away from a fully axial alignment with port 42 causing body 50 and post 30 to have limited, incidental contact with coupler 20 resulting in an undependable, limited number of points electrical ground path.

Figure 3:
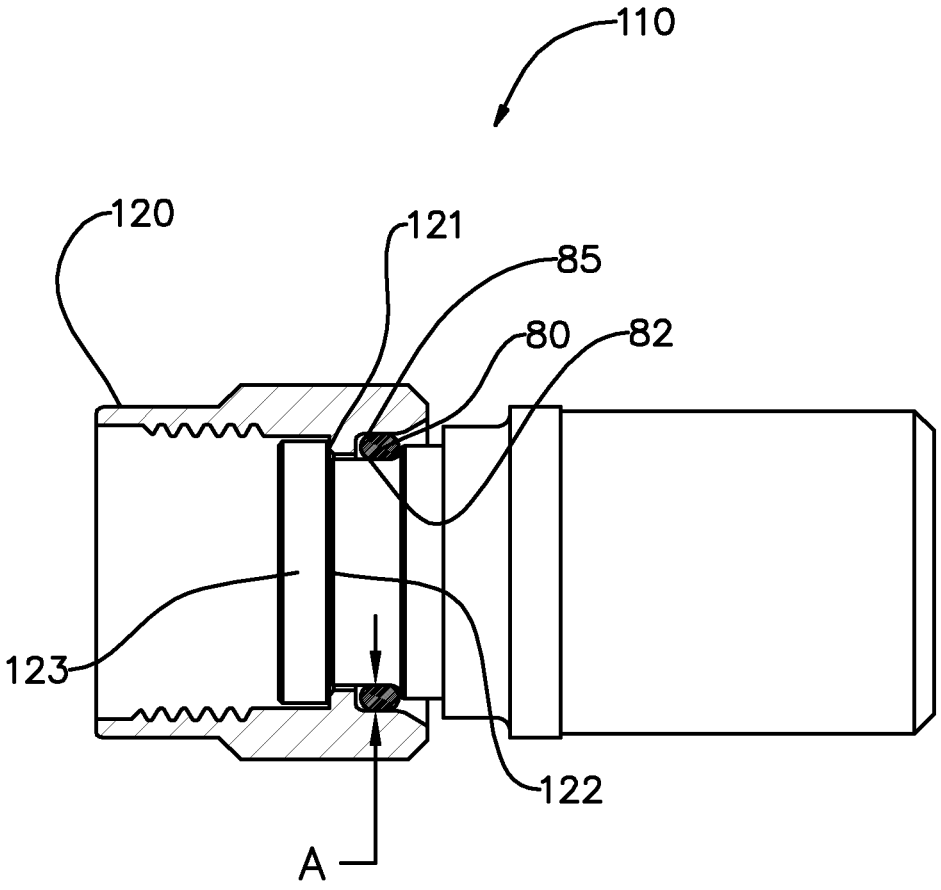
FIG. 3 PRIOR ART
FIG. 3 illustrates a partial cross sectional view of an alternative prior art connector in an uninstalled condition to illustrate o-ring utilization.

FIG. 3 illustrates a partial cross sectional view of an alternative prior art connector in an uninstalled condition illustrating o-ring utilization known and practiced in the art. O-ring 80 is compressed radially as illustrated at "A" (as opposed to being compressed axially) and is conventionally used as a moisture barrier. O-ring 80 is allowed axial clearance in order to ensure rotatability of coupler 120. This necessary clearance allows limited axial movement of coupler 120 and permits gapping between annular shoulder 121 of coupler 120 and annular shoulder 122 of post 123. Said gapping results in a situation for a relatively unobstructed ingress path as previously described.

Figure 4:
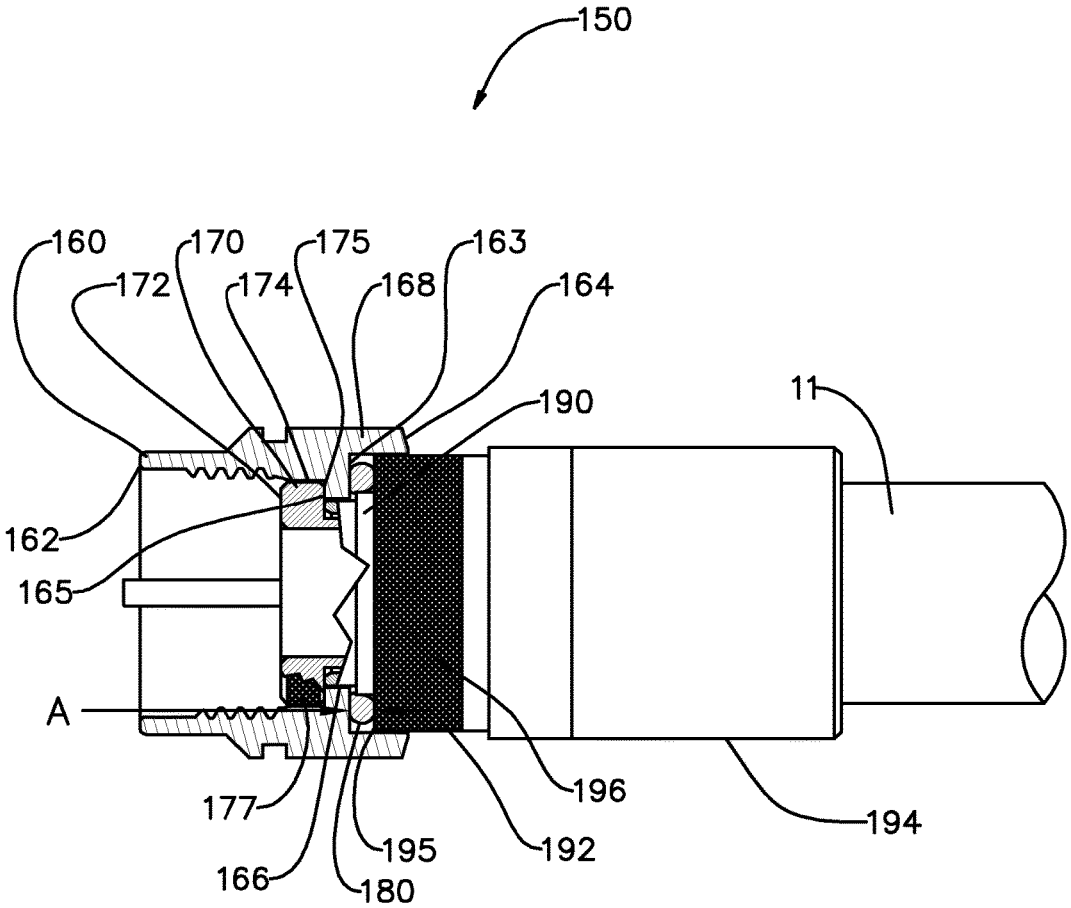
FIG. 4 illustrates a partial cross sectional view of a connector disclosed herein installed on a coaxial cable.

FIG. 4 illustrates a partial cross sectional view of a coaxial connector 150 as disclosed herein installed on a coaxial cable 11. Coaxial connector 150 includes coupling nut 160, post 170, sealing member 180, and body 190. Coupling nut 160, post 170, and body 190 are preferably made from a metallic material, such as brass and may optionally be plated with a conductive, corrosion-resistant material, such as nickel or tin.

Body 190 is preferably a hollow body having a front end 192, a rear end 194, and an internal surface (not shown) extending between the front and the rear end, wherein the internal surface defines a longitudinal opening.

Post 170 is preferably a tubular post disposed at least partially within the longitudinal opening of the body 190. Post 170 includes a front end 172 (including a forward facing post face), a rear end, (~~not shown~~) 202, a tubular shank 200 adjacent to the rear end (~~not shown~~) 202, and a flange 174 adjacent to the front end 172, wherein the flange 174 has an outer diameter that is larger than the outer diameter of the tubular shank 200.

Coupling nut 160 includes a front end 162, and a rear end 164, and a radially inward directed collar 166 with a circular aperture formed therein. The circular aperture formed in the radially inward directed collar 166 has a diameter that is less than the outer diameter of the flange 174 of the post 170. A front end facing surface 165 of the radially inward directed collar 166 rotationally engages a rear end facing surface 175 of the flange 174 of the post 170.

Sealing member 180 is disposed between a rear end facing surface 163 of the radially inward directed collar 166 and a front end facing surface 195 of the body 190. Sealing member 180 is preferably an o-ring that is preferably made from an elastomer material, such as EPDM (Ethylene Propylene Diene Monomer).

As illustrated in FIG. 4, internal features of coupling nut 160 and body 190 define an annular space to house sealing member 180. This annular space is configured to pre-load sealing member 180 in an axial fashion indicated by "A" (in contrast to prior art utilization of the o-ring as illustrated in FIG. 3). Alternatively stated, sealing member 180 is axially compressed by the rear end facing surface 163 of the radially inward directed collar 166 and the front end facing surface 195 of the body 190. While the sealing member 180 performs an environmental sealing function, it now also serves to urge coupling nut 160 forward against post flange 174 to aid in electrical grounding. This, in conjunction with precision engineered fits between coupling nut 160, post 170, and body 190 restricts RF signal ingress paths from the rear of the connector coupler system. The increased convoluted RF ingress path "P" defined by the juxtaposition of coupling nut 160, post 170, and body 190 serves as a further barrier against RF signal ingress.

As further illustrated in FIG. 4, front end 192 and front end facing surface 195 of body 190 have a larger outer diameter than an outer diameter of the sealing member 180. In addition, to the rear of the radially inward directed collar 166, the coupling nut 160 includes a rearward extending annular portion 168 having a circular aperture formed therein. The circular aperture in the rearward extending annular portion 168 has a diameter that is greater than the circular aperture formed in the radially inward directed collar 166 and at least a portion of an inner surface of the rearward extending annular portion 168 contacts and circumferentially surrounds at least a portion of an outer surface of the body 190. Preferably, the circular aperture in the rearward extending annular portion 168 of the coupling nut 160 and the portion of the body 190 that is circumferentially surrounded by the rearward extending annular portion 168 of the coupling nut 160 each have an outer diameter that is greater than the outer diameter of the flange 174 of the post 170. Preferably, sealing member 180 also has an outer diameter that is greater than the outer diameter of the flange 174 of the post 170. Preferably, an outer diameter of the sealing member 180 does not contact the inner surface of the rearward extending annular portion 168 of the coupling nut 160 and an annular gap extends between the outer diameter of the sealing member 180 and the inner surface of the rearward extending annular portion 168 of the coupling nut 160. Annular gap allows for sealing member 180 to flex radially outwardly as it is being compressed axially.

In the embodiment illustrated in FIG. 4, sealing member 180 that is axially compressed by the rear end facing surface 163 of the radially inward directed collar 166 and the front end facing surface 195 of the body 190 does not contact post 170 (as opposed to the embodiment illustrated in FIG. 12 and described below).

Preferably, and as illustrated in FIG. 4, the portion of the body 190 that is circumferentially surrounded by the rearward extending annular portion 168 of the coupling nut 160 comprises a plurality of contact points 196 on its outer surface, wherein at least a portion of an outer surface of the contact points contact the inner surface of the rearward extending annular portion 168 of the coupling nut 160. For example, in a preferred embodiment, the contact points 196 comprise radially outwardly extending geometrically shaped projections, such as diamond-shaped, square-shaped, or circular-shaped projections. In a particularly preferred embodiment, and as illustrated in FIG. 4, the contact points 196 on the outer surface of body 190 comprise a knurled outer surface.

Figure 4A:
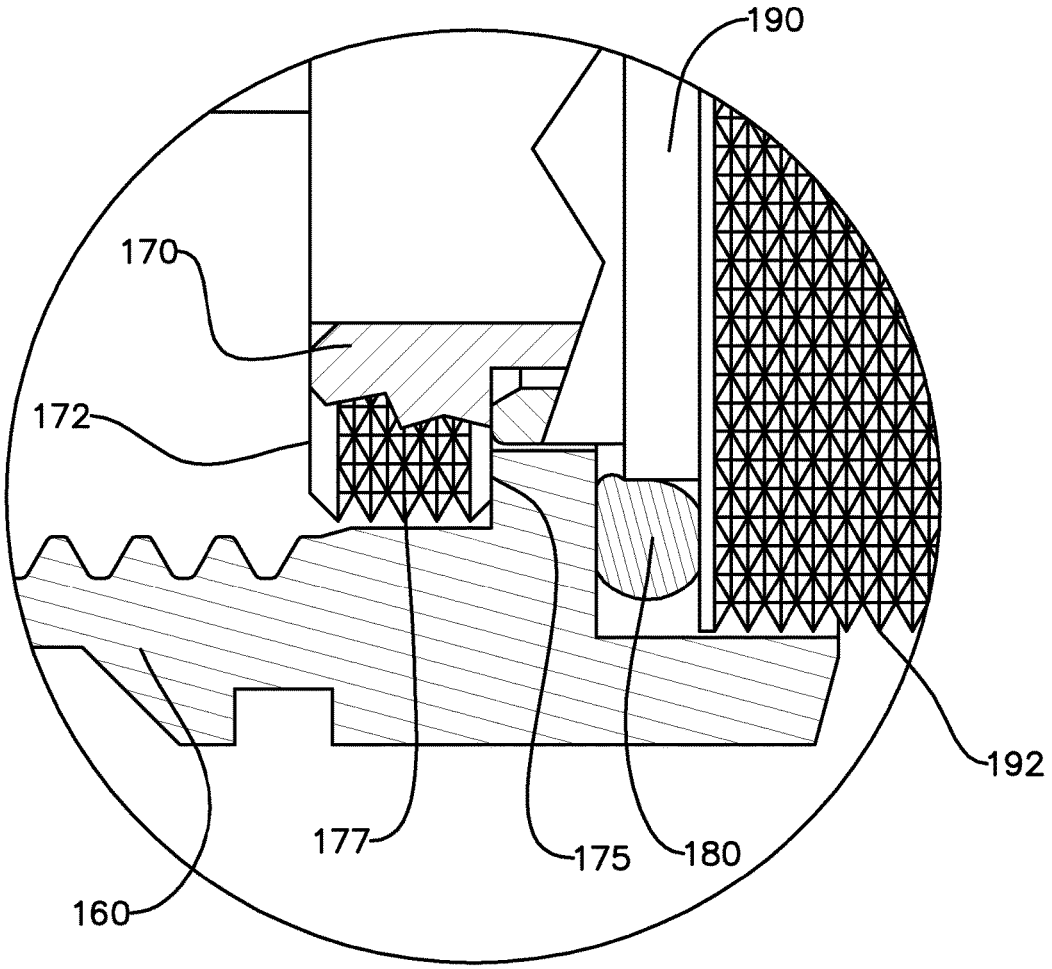
FIG. 4A illustrates an enlarged view of a portion of the connector illustrated in FIG. 4.

Post flange 174 also preferably comprises a plurality of contact points 177 on its outer surface, wherein at least a portion of an outer surface of the contact points contact an inner surface of the coupling nut 160. For example, in a preferred embodiment, the contact points 177 comprise radially outwardly extending geometrically shaped projections, such as diamond-shaped, square-shaped, or circular-shaped projections. In a particularly preferred embodiment, and as illustrated in FIG. 4, the contact points 177 on the outer surface of post flange 174 comprise a knurled outer surface. An enlarged view of these features is illustrated in FIG. 4A.

Formation of radially outwardly extending geometrically shaped projections as contact points about post flange 174 and body 190 by knurling or other means provides for increased contact pressure between the radial features of the connector components when the connector is in a loose condition (as illustrated, for example, in FIG. 6) further restricting RF signal ingress paths from the rear of the connector coupler system. Contact points 177 and/or 196 further serve to disrupt RF signal ingress by dispersing spurious RF signals in a manner roughly analogous to the use of LO technology (low observable technology) multi-planar surfaces employed on radar reflecting ships and aircraft. A further analogy to this approach is found in RF anechoic chamber technology.

Figure 5:
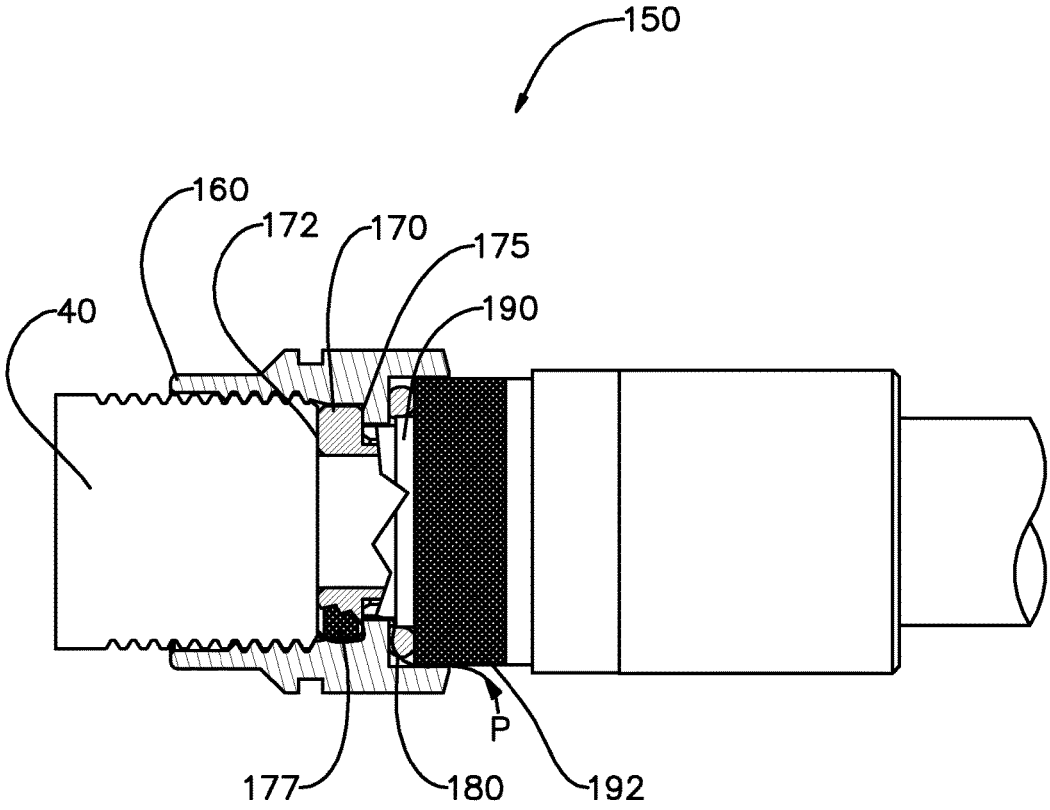
FIG. 5 illustrates a partial cross sectional view of the connector of FIG. 4 installed on a coaxial cable and fully secured to a terminal or port.

FIG. 5 illustrates a partial cross sectional view of the connector 150 illustrated in FIG. 4 installed on a coaxial cable and fully secured to a terminal or port 40. In this condition, all ingress paths are fully shielded as provided by application of proper torque to connector coupler 160.

Figure 6:
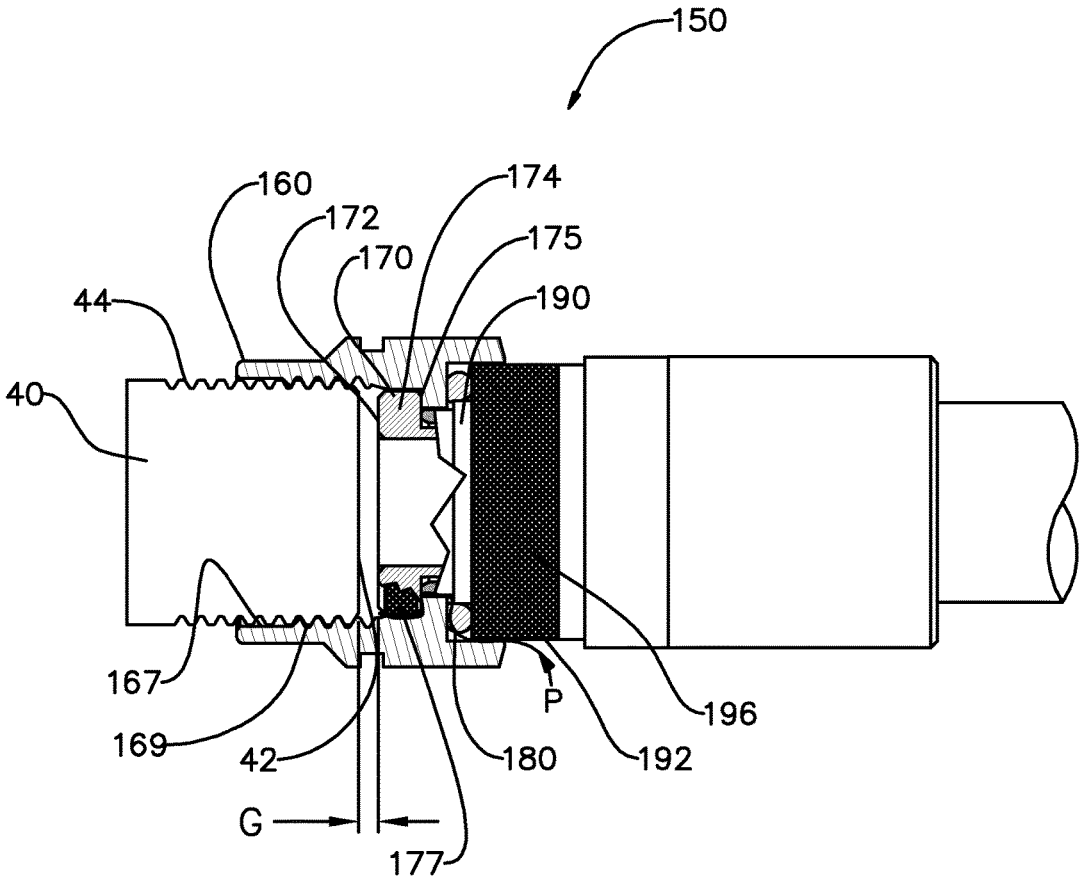
FIG. 6 illustrates a partial cross sectional view of the connector of FIG. 4 installed on a coaxial cable and partially secured to a terminal or port.

Turning to FIG. 6, the connector 150 illustrated in FIG. 4 and port 40 are illustrated where coupler 160 of connector 150 is not fully tightened thereby allowing post front end 172 (including post face) and port face 42 to be spaced apart at gap "G". As previously described, sealing member 180 performs not only an environmental sealing function but also serves to urge coupler 160 forward against post flange 174 to aid in electrical grounding. This, in conjunction with precision engineered fits between coupling nut 160, post 170 and body 190, restricts RF signal ingress paths from the rear of the connector coupler system. Forming of a plurality of contact points 177 about post 170 and a plurality of contact points 196 about body 190 by knurling or other means provides for increased contact pressure between the radial features of the connector components when the connector is in a loose condition as illustrated. The RF signal ingress path is further thwarted by the increased convolutions of the coupler/body/post configuration. This is especially useful in that RF signals tend to attenuate when presented by multiple, sharp changes in direction as provided herein. Additional thwarting of the RF ingress path on the port side of the coupler system is accomplished by restricting or choking the diametral clearances between inner bore of the front end of the coupling nut (or pilot bore 167) and major diameter port threads 44 of port 40. Further thwarting of the RF ingress path on the port side of the coupler system is accomplished by restricting or choking the diametral clearances between threads 169 of coupler 160 and minor diameter port threads 44 of port 40.

Figure 7:
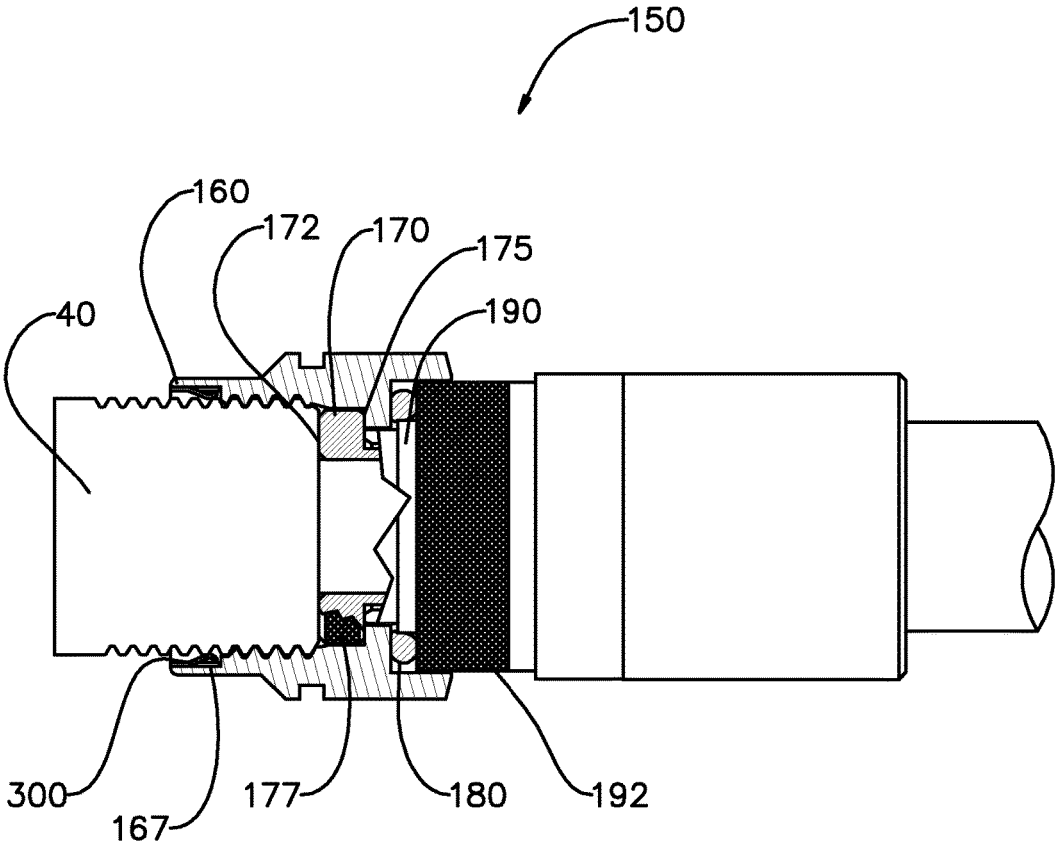
FIG. 7 illustrates a partial cross sectional view of an alternate embodiment of a connector comprising an alternate ground member and installed on a coaxial cable and fully secured to a terminal or port.

FIG. 7 illustrates a partial cross sectional view of an alternate embodiment of a connector 150 comprising an electrically conductive ground member 300 and installed on a coaxial cable 11 and fully secured to a terminal or port 40.

Ground member 300 is preferably press-fitted into pilot bore 167 of coupling nut 160 and comprises a plurality of radially inwardly biased fingers that provide electrical and mechanical communication between coupling nut 160 and port 40. The ground member 300 is preferably made from a metallic material, such as beryllium copper and may optionally be plated with a conductive, corrosion-resistant material, such as tin. Alternatively, the ground member 300 may be a coil-type spring or alternatively, the ground member 300 may be an electrically conductive elastomer.

Figure 7A:
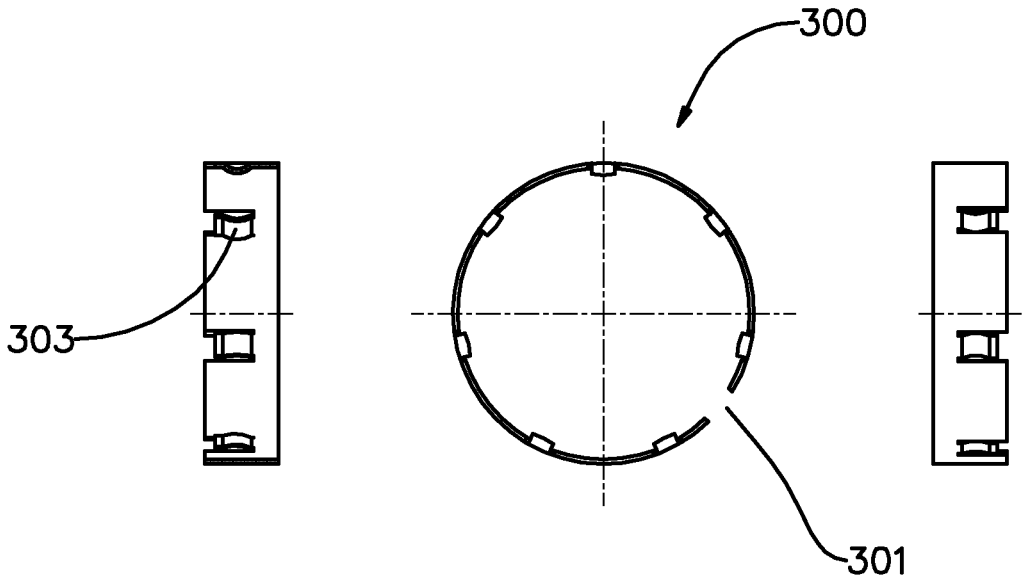
FIG. 7A illustrates side perspective and schematic end views of the alternate ground member shown on the connector illustrated in FIG. 7.

FIG. 7A illustrates side perspective and schematic end views of electrically conductive ground member 300 including radially inwardly biased fingers 303. Ground member 300 may, as shown in FIG. 7A, be c-shaped and include an optional radially extending slot 301. Alternatively, ground member 300 may entirely circumferentially surround pilot bore 167 (not shown).

Figure 8:
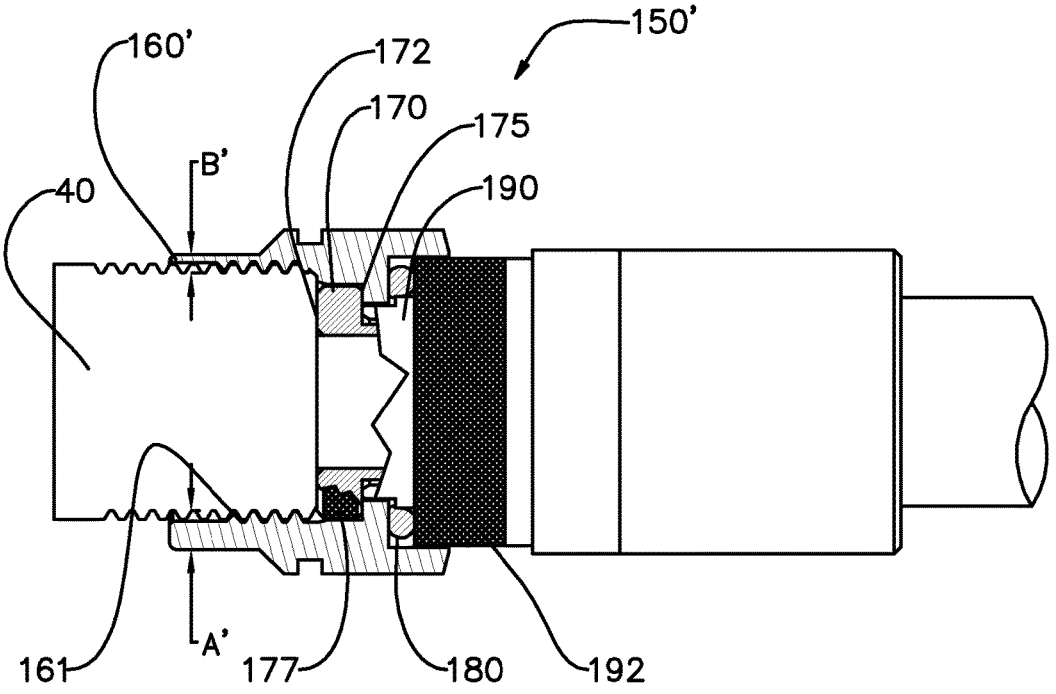
FIG. 8 illustrates a partial cross sectional view of an alternate embodiment of a connector comprising a coupling nut having an offset thread and installed on a coaxial cable and fully secured to a terminal or port.
Figure 8A:
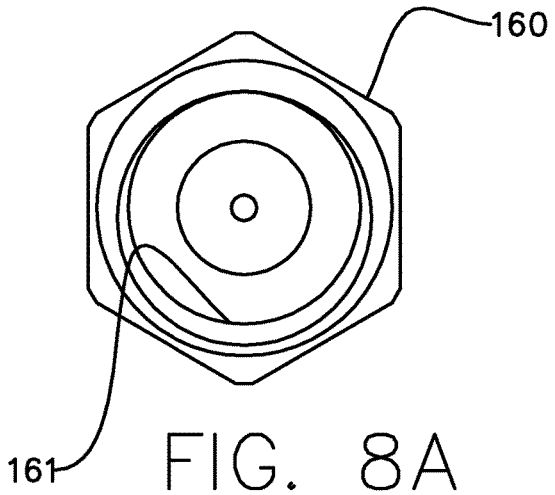
FIG. 8A illustrates a posterior schematic end view of the connector illustrated in FIG. 8.

FIG. 8 illustrates a partial cross sectional view of an alternate embodiment of a connector 150' comprising a coupling nut having an offset inner thread 161 and installed on a coaxial cable 11 and fully secured to a terminal or port 40. Offset inner thread 161 is built into coupling nut 160' at an axis parallel to the center axis of coupling nut 160' but radially displaced from the center axis of coupling nut 160' such that the annular thickness of the coupling nut 160' between an inner surface and an outer surface varies circumferentially around the coupling nut 160'. For example, as illustrated in FIG. 8, the annular thickness of coupling nut 160' at A' is greater than the annular thickness of coupling nut 160' at B'. Preferably, the coupling nut 160' has an annular thickness that varies circumferentially around pilot bore 167 (see FIG. 8A, showing a posterior schematic end view of the connector illustrated in FIG. 8) such that the largest annular thickness of the coupling nut 160' around pilot bore 167 is at least 10%, more preferably at least 20%, and even more preferably at least 30% greater than the smallest annular thickness of coupling nut 160' around pilot bore 167. This has the effect of purposely misaligning connector 150' with port 40 forcing the cable center conductor (not shown) into a side-loaded condition. In this side-loaded condition, the copper coated steel center conductor is forced to act as a spring and thereby apply a force that enhances radial contact between threads of coupling nut 160' and thread 44 of port 40 ensuring an electrical ground path.

Figure 9:
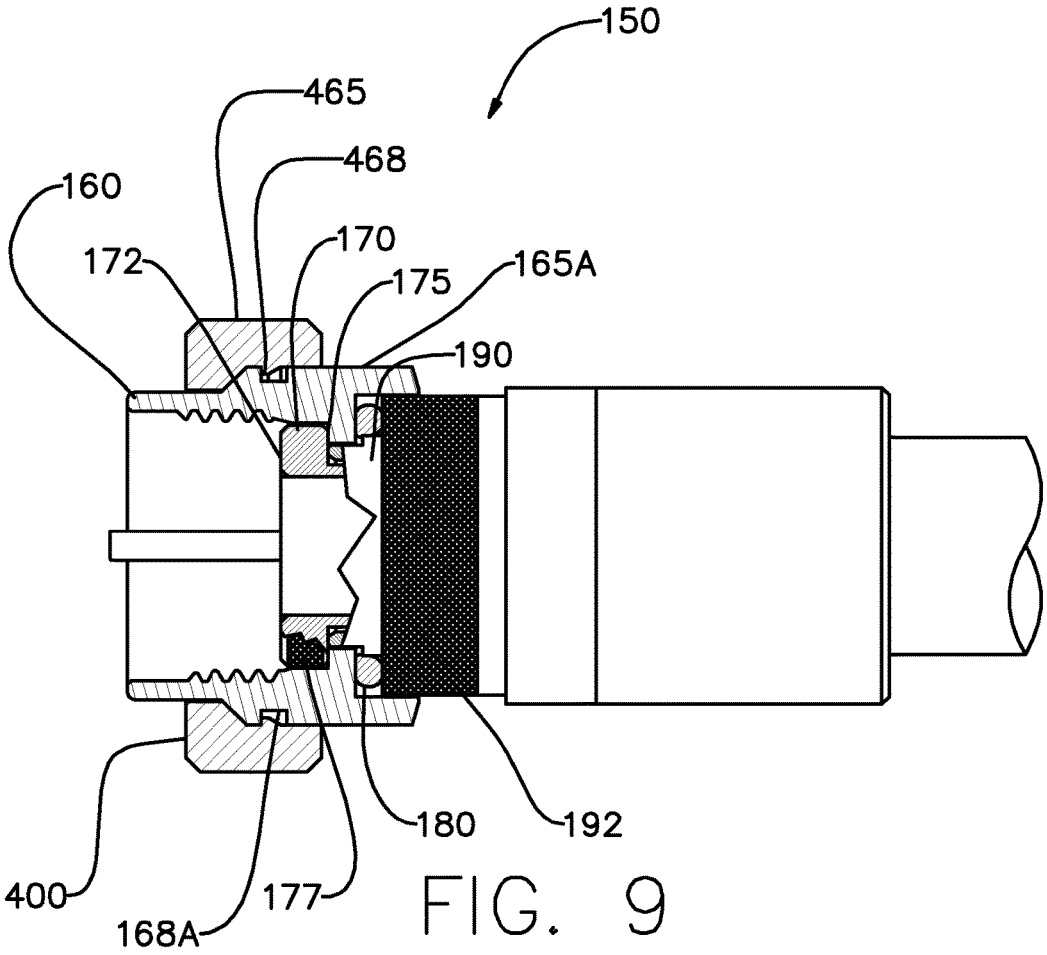
FIG. 9 illustrates a partial cross sectional view of the connector of FIG. 4 with an optional torque aid installed.
Figure 10:
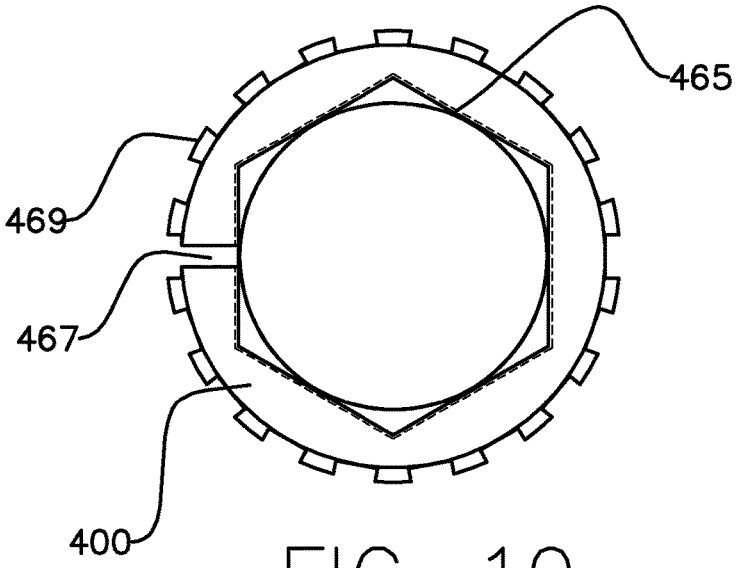
FIG. 10 illustrates a schematic end view of the optional torque aid illustrated in FIG. 9.

FIG. 9 illustrates a partial cross sectional view of connector 150 and an optional torque aid 400, wherein the torque aid 400 is installed on the connector 150 and is in contact with and circumferentially surrounds at least a portion of coupling nut 160. FIG. 10 illustrates a schematic end view of torque aid 400. Torque aid 400 is preferably made from a plastic material, such as acetal, and allows for the connector to be more adequately installed onto a port in limited accessibility situations by providing for improved finger grip on the coupler system. As shown in FIG. 10, torque aid 400 includes internal hex 465 which is configured to engage external hex 165A of coupling nut 160 while internal ridge 468 engage grooves 168A of coupling nut 160. Optional radially extending slot 467 allows torque aid 400 to snap over and onto coupling nut 160. A plurality of optional external gripping surfaces 469 provide for enhanced finger grip. Torque aid 400 is of further benefit in reducing the manufacturing cost of coupling nut 160 by eliminating the need to produce coupling nut 160 from a larger material stock size as seen in Corning Gilbert Connector GF-UR-6K currently produced for the industry.

Figure 11:
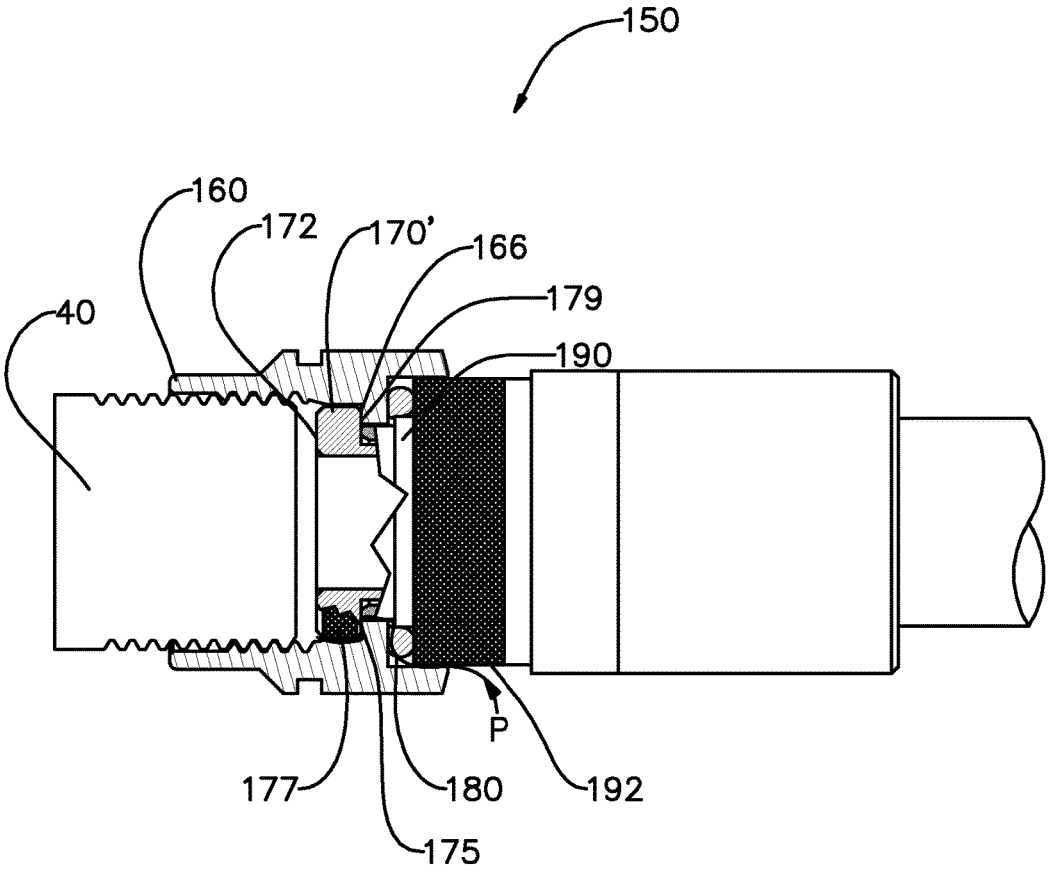
FIG. 11 illustrates a partial cross sectional view of an alternate embodiment of a connector comprising a modified post.
Figure 11A:
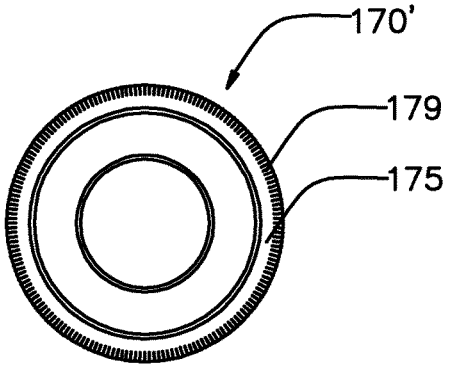
FIG. 11A illustrates an anterior schematic end view of the post illustrated in FIG. 11.

FIGS. 11 and 11A illustrate an alternate embodiment, wherein FIG. 11 illustrates a partial cross sectional view of a connector comprising a modified post 170' and FIG. 11A illustrates a schematic end view of modified post 170'. Modified post 170' comprises radial knurl 179 on rear end facing surface 175 of post flange 174 that provides high pressure contact points between front end facing surface 165 of radially inward directed collar 166 of coupling nut 160 and crests of radial knurl 179. Reducing the square inches of contact area between the surfaces increases contact pressures in PSI (pounds per square inch) when the same load is applied by the coupler system. Such increased contact pressures enhance electrical grounding characteristics.

Figure 12:
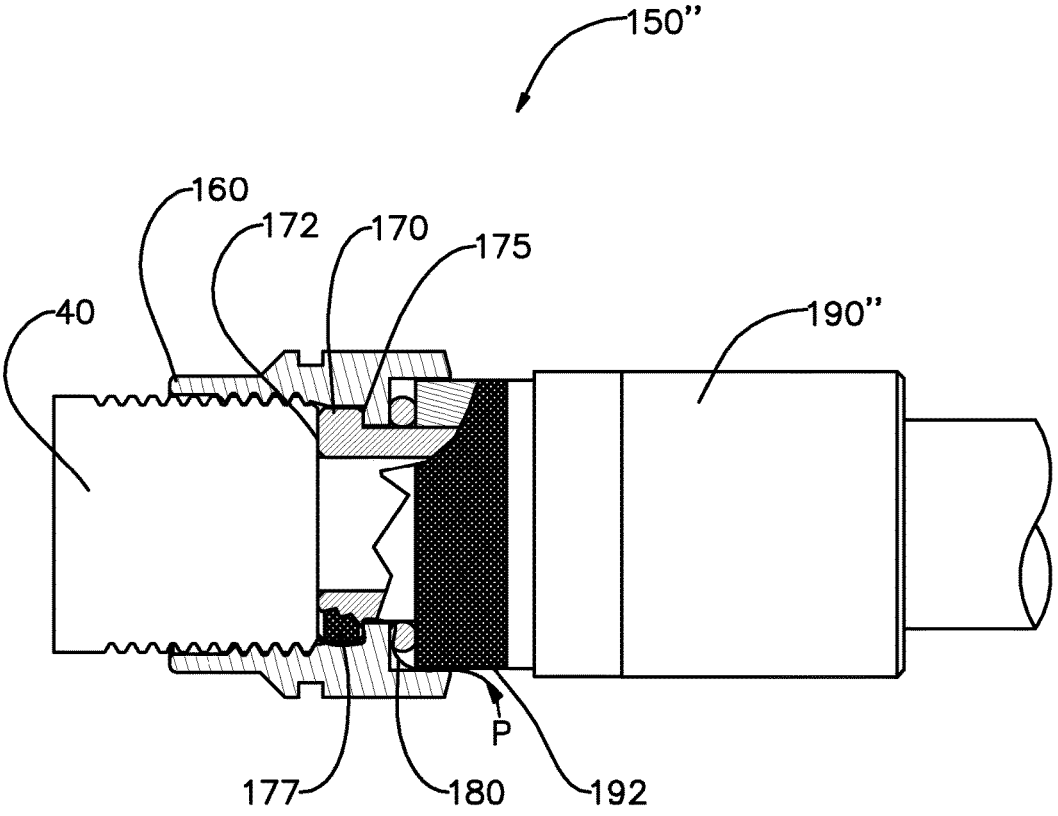
FIG. 12 illustrates a partial cross sectional view of an alternate embodiment of a connector comprising a sealing member disposed between the coupler, post, and body.

FIG. 12 illustrates a partial cross sectional view of an alternate embodiment of a connector 150" wherein sealing member 180 is disposed between the coupling nut 160, post 170, and body 190", such that an inner surface of the sealing member 180 contacts post 170 (in contrast to the connector illustrated in FIG. 4, wherein an inner surface of the sealing member 180 contacts body 190).

Figure 13:
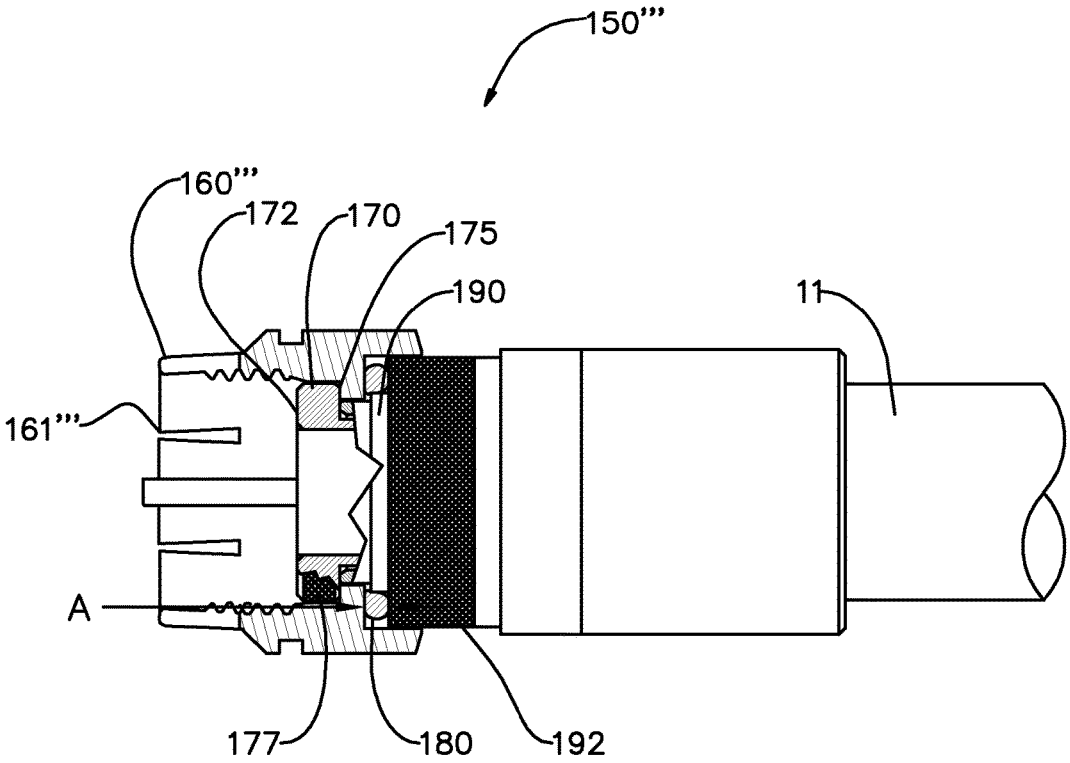
FIG. 13 illustrates a partial cross sectional view of an alternate embodiment of a connector having a coupling nut having a radially inwardly biased front end and a plurality of slots.

FIG. 13 illustrates a partial cross sectional view of an alternate embodiment of a connector 150''', wherein coupling nut 160''' has a front end that is formed or biased radially inwardly and front end of coupling nut 160''' includes a plurality of slots 161''' extending from the front end of the coupling nut between an inner and an outer surface of the front end of the coupling nut 160'''. The radially inwardly biased front end of coupling nut 160''' help insure that the threads of the coupling nut 160''' contact a mating port (not shown) and the slots allow for spring or flex back functionality to facilitate mating of the threads of the coupling nut with threads on a mating port (not shown).

Figure 14:
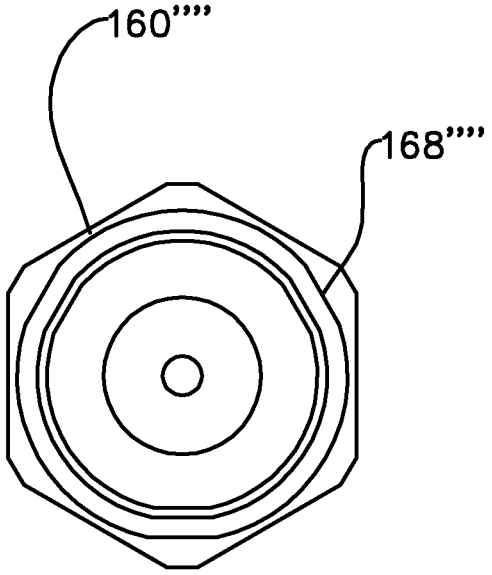
FIG. 14 illustrates a schematic front end view of an alternate embodiment of a coupling nut having an at least partially unrounded inner surface.

FIG. 14 illustrates a schematic front end view of an alternate embodiment of a coupling nut 160'''' that can be used with one or more embodiments of connectors described herein, wherein the front end of coupling nut 160'''' has an at least partially unrounded surface. Preferably, the at least partially unrounded surface is an inner surface on the front end of the coupling nut 160'''' although, as shown in FIG. 14, both inner and outer surfaces on front end of coupling nut may be unrounded. By "unrounded" it is meant that the front end of the coupling nut includes one or more intentionally introduced deformations wherein the deformations result in the front end of the coupling nut 160'''' having inner and/or outer surfaces that are not perfectly circular when viewed head on from the front end. For example, FIG. 14 illustrates a coupling nut 160'''' having a front end with intentionally introduced deformations shown as a plurality of flat spots 168'''' (flat spots 168'''' are shown in an exaggerated fashion for the purposes of illustration). The at least partially unrounded inner surface allow for the threads of the coupling nut 160''' to more positively contact a mating port (not shown).

Coaxial connectors disclosed herein can, in preferred embodiments, mitigate the effect of gapping at the connector/port interface, provide an alternative ground path, provide a means to protect from signal ingress and egress, and help ensure against further loosening of an unsecured coupler.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial connector for coupling an end of a coaxial cable to a terminal, the coaxial connector comprising:

a hollow body comprising a front end, a front end facing surface, a rear end, and an internal surface extending between the front end and the rear end, the internal surface defining a longitudinal opening;

a tubular post disposed at least partially within the longitudinal opening of the hollow body, the tubular post comprising a front end, a rear end, and a front end flange;

a coupling nut having a front end, a rear end, a radially inward directed collar, and a rearward extending annular portion to the rear of the radially inward directed collar, wherein the radially inward directed collar of the coupling nut comprises a rear end facing surface that opposes the front end facing surface of the hollow body, and the radially inward directed collar rotationally engages a rear end facing surface of the front end flange of the tubular post; and a sealing member disposed in an annular space defined by internal features of the coupling nut and the hollow body, between the rear end facing surface of the radially inward directed collar and a front end facing surface of the hollow body, wherein the sealing member is axially compressed by the rear end facing surface of the radially inward directed collar and the front end facing surface of the hollow body to axially pre-load the sealing member, an outer diameter of the sealing member does not contact an inner surface of the rearward extending annular portion of the coupling nut, and an annular gap extends between the outer diameter of the sealing member and the inner surface of the rearward extending annular portion of the coupling nut to allow the sealing member to flex radially outwardly as it is being compressed axially;

wherein the flange of the tubular post comprises a plurality of contact points on an outer surface and at least a portion of an outer surface of the contact points contacts an inner surface of the coupling nut.

2. The coaxial connector of claim 1, wherein the sealing member comprises an O-ring.

3. The coaxial connector of claim 1, wherein the front end facing surface of the hollow body has a larger outer diameter than an outer diameter of the sealing member.

4. The coaxial connector of claim 1, wherein the sealing member has an outer diameter that is larger than an outer diameter of the flange of the post.

5. The coaxial connector of claim 1, wherein a circular aperture in the rearward extending annular portion of the coupling nut and a portion of the hollow body that is circumferentially surrounded by the rearward extending annular portion of the coupling nut each have an outer diameter that is greater than the outer diameter of the flange of the post.

6. The coaxial connector of claim 1, wherein the flange of the tubular post comprises a plurality of contact points on an outer surface and at least a portion of an outer surface of the contact points contacts an inner surface of the coupling nut.

7. The coaxial connector of claim 1, wherein an inner surface of the sealing member contacts the hollow body.

8. The coaxial connector of claim 1, wherein an inner surface of the sealing member contacts the tubular post.

9. The coaxial connector of claim 1, wherein the front end of the coupling nut is biased radially inwardly and the coupling nut comprises a plurality of slots extending from the front end of the coupling nut between an inner and an outer surface of the front end of the coupling nut.

* * * * *